US006354033B1

(12) United States Patent
Findley

(10) Patent No.: US 6,354,033 B1
(45) Date of Patent: Mar. 12, 2002

(54) ELECTRIC GUN

(76) Inventor: Stephan D. Findley, 710 Willow St., Midland, TX (US) 75670

( * ) Notice: Subject to any disclaimer, the term of this patent is extended or adjusted under 35 U.S.C. 154(b) by 0 days.

(21) Appl. No.: 09/213,646

(22) Filed: Dec. 17, 1998

(51) Int. Cl.[7] ..... F41A 19/58; F41A 17/06; F41A 17/20

(52) U.S. Cl. ..... 42/84; 42/70.01; 42/70.11

(58) Field of Search ..... 42/84, 70.01, 70.11; 89/28.05, 135

(56) References Cited

U.S. PATENT DOCUMENTS

| | | | | | |
|---|---|---|---|---|---|
| 2,072,621 | A | | 3/1937 | Gagle | |
| 2,548,946 | A | | 4/1951 | Clauser et al. | |
| 2,780,882 | A | * | 2/1957 | Temple | 42/84 |
| 2,918,871 | A | | 12/1959 | Taylor | |
| 3,250,034 | A | * | 5/1966 | Simmons | 42/84 |
| 3,563,177 | A | | 2/1971 | Ritchey | |
| 3,580,113 | A | * | 5/1971 | Ramsay et al. | 42/84 |
| 3,613,282 | A | * | 10/1971 | Ramsay | 42/84 |
| 3,726,217 | A | | 4/1973 | Dedman et al. | |
| 3,754,506 | A | | 8/1973 | Parker | |
| 4,070,970 | A | | 1/1978 | Scamaton | |
| 4,217,717 | A | | 8/1980 | Canty et al. | |
| 4,324,060 | A | * | 4/1982 | Lawrence | 42/84 |
| 4,332,098 | A | * | 6/1982 | Estenevy | 42/84 |
| 4,457,091 | A | * | 7/1984 | Wallerstein | 42/70.11 |
| 4,467,545 | A | * | 8/1984 | Shaw, Jr. | 42/70.01 |
| 4,763,431 | A | * | 8/1988 | Allan et al. | 42/70.11 |
| 4,970,819 | A | * | 11/1990 | Mayhak | 42/70.01 |
| 5,044,278 | A | | 9/1991 | Campbell | |
| 5,235,127 | A | | 8/1993 | Findley | |
| 5,267,406 | A | * | 12/1993 | Ruger et al. | 42/70.01 |
| 5,301,448 | A | * | 4/1994 | Petrick et al. | 42/70.01 |
| 5,353,710 | A | | 10/1994 | Eches et al. | |
| 5,361,702 | A | | 11/1994 | Goetz | |
| 5,461,812 | A | * | 10/1995 | Bennett | 42/70.11 |
| 5,502,915 | A | * | 4/1996 | Mendelsohn et al. | 42/70.11 |
| 5,515,783 | A | | 5/1996 | Hesse et al. | |
| 5,625,972 | A | * | 5/1997 | King et al. | 42/84 |
| 5,739,459 | A | | 4/1998 | La Mura et al. | |
| 5,755,056 | A | * | 5/1998 | Danner et al. | 42/84 |
| 5,767,439 | A | | 6/1998 | Lindblom et al. | |
| 5,915,936 | A | * | 6/1999 | Brentzel | 42/70.11 |
| 5,937,557 | A | * | 8/1999 | Bowker et al. | 42/70.01 |
| 6,185,852 | B1 | * | 2/2001 | Whalen et al. | 42/70.11 |

FOREIGN PATENT DOCUMENTS

| | | | | |
|---|---|---|---|---|
| CH | 679243 | * | 1/1992 | 42/84 |
| DE | 2837738 | * | 2/1980 | 42/84 |
| FR | 1446514 | * | 6/1966 | 42/84 |
| GB | 816530 | | 7/1959 | |
| GB | 2340589 | * | 2/2000 | |
| WO | WO 92/13249 | * | 8/1992 | 42/70.11 |
| WO | WO 97/44630 | * | 11/1997 | |
| WO | WO 98/02705 | * | 1/1998 | |

* cited by examiner

*Primary Examiner*—Darren W. Ark
(74) *Attorney, Agent, or Firm*—Randall C. Brown; Priscilla L. Ferguson; Akin, Gump, Strauss, Hauer & Feld, L.L.P.

(57) ABSTRACT

An electric gun, such as a handgun, is operable to fire a cartridge having an electrically ignitable bullet propelling charge disposed therein. The cartridge includes a non-conductive casing and a center electrode which conducts an electric signal to the ignitable charge and through the charge to the bullet or to a second electrode on the cartridge. A firing signal is generated by a circuit which includes a microcontroller and plural code signal producing switches for entering a predetermined authorization code to unlock the cartridge firing circuit. Infrared sensors are mounted spaced apart on the gun handgrip in such a way as to arm the circuit for firing only when the gun is being gripped in a predetermined manner. Operation of a trigger closes a firing signal switch connected to the microcontroller to effect a firing signal delivered to the electric cartridge. The gun body may be fabricated substantially of a suitable plastic material.

15 Claims, 3 Drawing Sheets

ELECTRIC GUN

FIELD OF THE INVENTION

The present invention pertains to a firearm which fires an electrically ignited cartridge, including circuitry for firing the cartridge and for providing enhanced security and safety of operation.

BACKGROUND

Firearms or "guns", such as handguns, rifles and shotguns, for example, have been extensively developed. However, substantially all firearms of the type mentioned above have been developed as primarily mechanical devices with regard to the configuration of the cartridge or shell and means for firing same, the trigger, the gun firing mechanism, features to prevent unwanted use of the gun and features providing safety in use. Mechanically actuated firearms have certain disadvantages with respect to reliability in operation and the ability to defeat or ignore security and safety devices which would prevent unwanted use or accidental discharge of the gun.

Still further, in the art of carriable firearms, in particular, a longstanding problem with mechanically actuated guns is the weight of the gun due to the complexity of the firing mechanism and the fact that substantially all guns have been fabricated substantially of metal components.

However, with the development of electrically ignitable cartridges, including those in accordance with my inventions, there has been an opportunity to provide an electrically operated firearm comprising either a handgun or long gun which provides several advantages in the art of firearms. It is to this end that the present invention has been developed.

SUMMARY OF THE INVENTION

The present invention provides an electrically operated firearm or gun.

In accordance with one aspect of the present invention, a firearm, such as a handgun, rifle or shotgun, is provided which may be of a conventional caliber or gauge, and which utilizes an electrically fired cartridge ignited by an electric circuit disposed on the firearm and operably associated with a trigger mechanism.

In accordance with another aspect of the present invention an electrically operated firearm is provided which is operable to fire an electrically ignited cartridge which is similar in some respects to conventional cartridges. The firearm or gun, is similar in some respect to conventional guns or weapons, other than being adapted for firing the electrically ignited cartridge and including suitable electrical circuitry for achieving same. In this way persons familiar with conventional firearms may easily become familiar with and operate a gun in accordance with the present invention.

In accordance with another aspect of the present invention an electrically operated gun is provided which includes means to prevent unwanted firing or discharge and to minimize accidental discharge. With regard to the first mentioned feature, the gun is provided with a unique electrical circuit which requires the input of a digital code signal to the circuit in order to cause the gun to be "armed" and ready for firing upon proper handling thereof. With regard to the second mentioned feature, the gun requires that it be suitably grasped for use in the firing position before the trigger will be operable.

In particular, in regard to the first mentioned security feature a digital keypad is provided on the handle or grip portion of the gun which requires inputting a multi-digit code to "unlock" the gun for use. With regard to the second mentioned feature, a suitable array of detector or sensor devices mounted on the grip or handle portion of the firearm detects proper gripping or holding of the firearm to cause the trigger to be operable to fire an electrically ignited cartridge.

In accordance with yet another aspect of the present invention an electrically operated gun is provided which includes a unique combination of features including the overall construction of the gun itself, the use of an electrical circuit and an electrically ignited cartridge to cause the gun to fire a projectile or bullet. The gun is otherwise generally conventional in appearance and operating characteristics to minimize training and familiarization requirements for new users.

Those skilled in the art will further appreciate the above-mentioned features and advantages of the present invention together with other important aspects thereof upon reading the detailed description which follows in conjunction with the drawing.

DETAILED DESCRIPTION OF A PREFERRED EMBODIMENT

Figure 1:
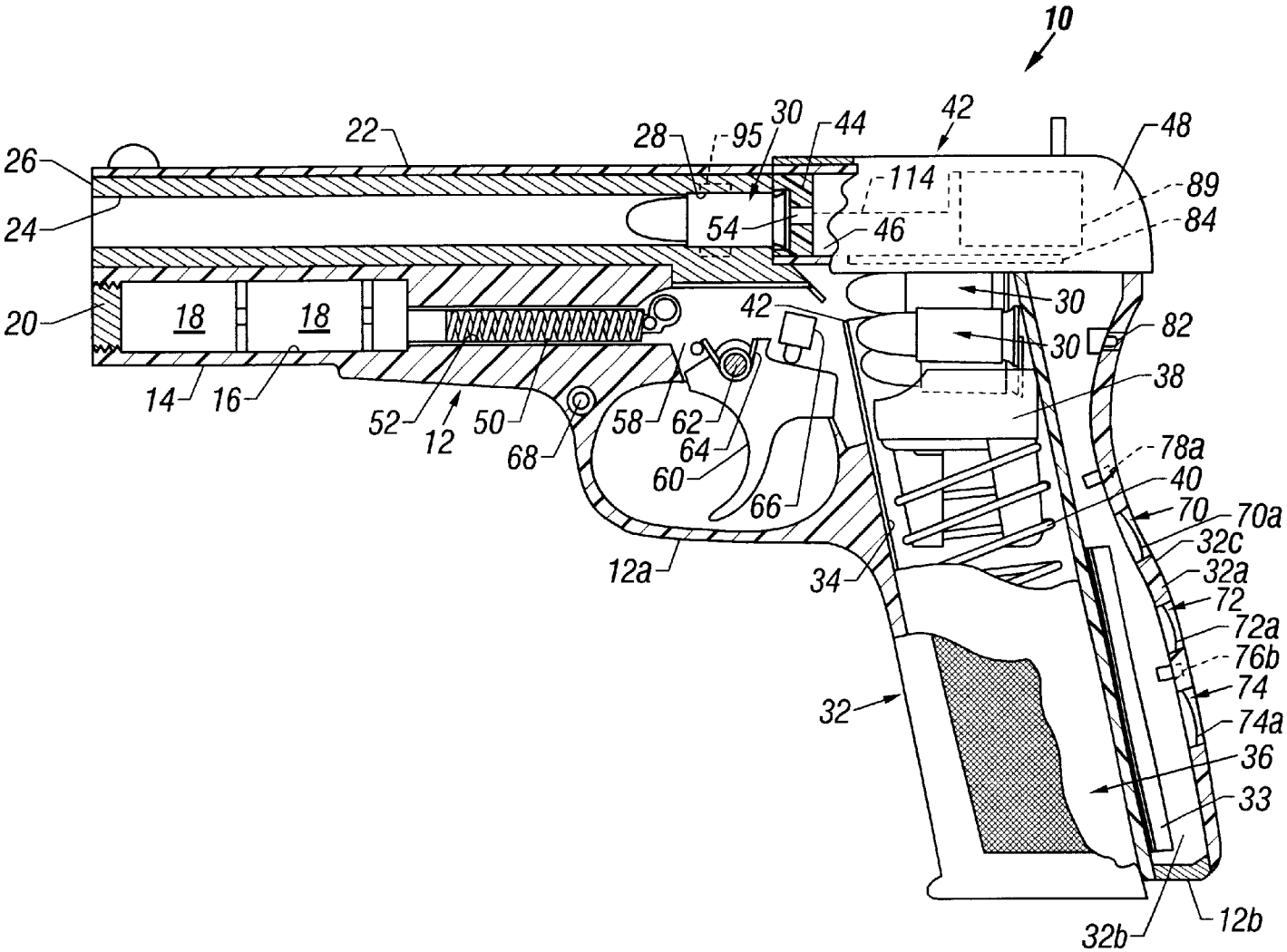
FIG. 1 is a side elevation, partially sectioned, of a handgun firearm in accordance with the present invention.

In the description which follows like parts are marked throughout the specification and drawing with the same reference numerals, respectively. The drawing FIGURES are not necessarily to scale and certain features may be shown in somewhat schematic or generalized form in the interest of clarity and conciseness.

Referring to FIG. 1, there is illustrated an electric gun in accordance with the present invention and generally designated by the numeral 10. The electric gun 10 is characterized as a handheld pistol or handgun of the semi-automatic type, that is to say that a cartridge, when fired, is automatically ejected from the cartridge receiving breech and an unfired cartridge is automatically moved into the breech without requiring operator action. The present invention also contemplates a single shot or fully automatic type operation of a gun or firearm in accordance with the invention.

In a preferred configuration of the gun 10, a body of the gun, generally indicated at 12, may be formed in two opposed longitudinally separable pieces or the body may be molded in a single piece with certain removable sections to facilitate construction and operation. The material of the body 12 is preferably a suitable plastic such as a reinforced polycarbonate and the body 12 includes a forward portion 14 including an elongated bore 16 formed therein for receiving one or more low-voltage batteries 18, as shown, suitably retained in the bore 16 by a removable threaded plug 20. The body 12 also includes an elongated barrel member 22 supported therein and including a bore 24 extending from a discharge end 26 of the barrel to an integral cartridge receiving breech 28 for receiving a suitable electrically ignitable cartridge 30. The construction of the cartridge 30 will be explained in further detail hereinbelow. Barrel 22 may be formed of a suitable metal composition or of a material such as a composite fiber epoxy composition.

The body 12 preferably includes an integral handgrip 32 with an elongated slot 34 formed therein for receiving a conventional clip type cartridge magazine 36 which is of somewhat conventional construction and includes a cartridge pusher member 38, a biasing spring 40 and an open upper end 42 for urging suitably stacked cartridges 30 upwardly toward a suitable action mechanism 42. The action mechanism 42 may be of somewhat conventional construction including a breech block 44 formed of a non-electrically conductive material and a bolt 46 carried by a slide member 48 which is reciprocable on the body 12 longitudinally with respect to the barrel bore 24 in a conventional manner. The action slide 48 may be suitably connected by linkage, not shown, to a return spring 50 mounted in a bore 52 in the body 12 for closing the breech 28 with breechblock 44 to retain a cartridge 30 in the breech. One important difference between the breechblock 44 and conventional bolts or breechblocks is that the breechblock 44 is formed of a non-electrically conductive material and includes a central axially elongated electrical conductor 54 therein and adapted to be in electrically conductive engagement with cartridge 30 and with a suitable electrical circuit to be explained in further detail herein.

The gun or firearm 10 of the present invention contemplates that the mechanism for placing a cartridge 30 in the breech 28, extracting the cartridge from the breech and replacing the spent cartridge with a fresh cartridge from the magazine 36 may be in accordance with conventional semi-automatic or automatic firearm construction used in conventional mechanical handguns, rifles or shotguns. Accordingly, the operation of the action mechanism 42, in response to gas pressure forces, for example, to extract a spent cartridge 30, once fired, eject that cartridge from the gun 10 and replace the spent cartridge with a fresh unfired cartridge from the magazine 36 is believed to be within the purview of one skilled in the art and, forming no part of the present invention, will not be explained in further detail herein.

Referring further to FIG. 1, the body 12 is also provided with a cavity 58 therein for supporting a trigger 60 for pivotal movement about a pivot pin 62 supported on the body. Trigger 60 is biased to a preparatory position, as shown in FIG. 1, by a suitable return spring 64. Trigger 60 is also adapted to actuate a switch 66 mounted in the body cavity 58, as shown in FIG. 1, and engageable with the trigger in response to "pulling" same. A suitable "safety mode" switch 68 is also mounted in the body 12 adjacent a trigger guard part 12*a* for a purpose to be explained further herein.

Referring further to FIG. 1, the grip 32 of the handgun 10 includes a substantially hollow rearward portion 32*a* having a suitable relatively large cavity 32*b* formed therein for receiving an electrical circuit supported in an enclosure 33 disposed in the cavity 32*b* and removable therefrom, when needed, by separating the aforementioned body half-parts, if desired or by supporting the enclosure 33 on a suitable removable body part 12*b*.

Figure 2:
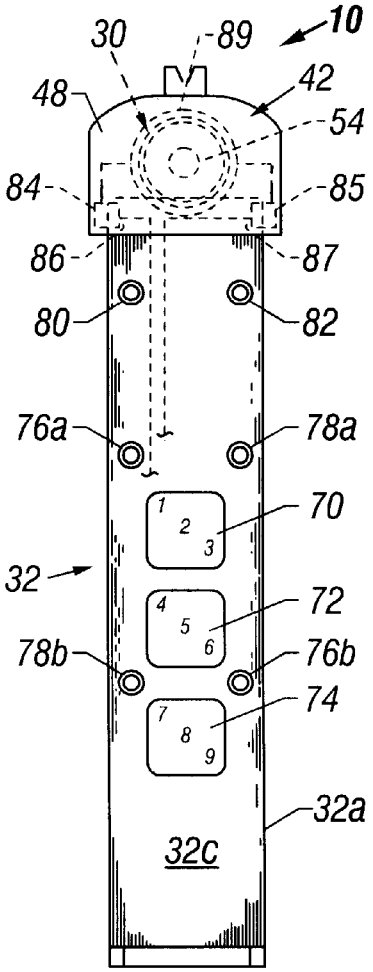
FIG. 2 is a rear elevation of the gun shown in FIG. 1.

Referring now to FIG. 2 also, the handgrip 32, which is adapted to receive the magazine 36 in a conventional manner, is further provided with push button switches 70, 72 and 74 spaced apart from each other and mounted in suitable recesses, respectively, in a substantially rearwardly facing surface 32*c* of grip portion 32*a*, as shown in FIG. 2. Push button switches 70, 72 and 74 comprise suitable switches interposed in the control circuit for the electric gun and to be described further herein. Also disposed generally on the rearwardly facing surface 32*c* are somewhat diagonally spaced apart pairs of sensors 76*a*, 76*b* and 78*a*, 78*b*, respectively. The sensor pair 76*a*, 76*b* is operable to sense when a person's hand is gripping the handgrip 32 in a conventional manner for use of the gun 10 and the sensor pair 78*a*, 78*b* is also adapted for sensing when a person is gripping the handgrip 32 in a conventional manner for use of the gun. The sensor pair 78*a*, 78*b* is operable to sense when a person is grasping the handgrip 32 with their right hand and the sensor pair 76*a*, 76*b* is operable to sense when a person is grasping the handgrip 32 with their left hand. In this way, if a person is holding the gun 10 in their right hand in a conventional manner ready for use and both sensors 78*a* and 78*b* detect the presence of the person's hand gripping the handgrip 32, a suitable signal is generated to enable the gun to be fired upon actuation of trigger 60. Conversely, if a person is properly gripping the gun in their left hand so that signals are generated by both sensors 76*a* and 76*b*, signals from these sensors would also provide a suitable control signal to indicate that the gun 10 is ready to be used for its intended purpose. In other words, the sensors 76*a*, 76*b* and 78*a*, 78*b* function as electronic "safety" devices to prevent firing of the gun 10 unless the gun is properly gripped in a normal firing position in either a person's left hand or right hand.

Also, as shown in FIG. 2, the handgrip 32 is provided with spaced apart indicators 80 and 82 which may be operable to indicate the firing status of the gun 10.

The digitally actuated push button switches, 70, 72 and 74 may be used to enter a suitable numeric code into the aforementioned control circuit of the gun 10 to "unlock" the gun and which circuit is adapted to be placed in a state of readiness for firing only if the proper code is entered at the push button switches, 70, 72 and 74. As shown in FIG. 2, suitable numeric characters are printed on the faces of the push button switches 70, 72 and 74 for this purpose. The faces 70*a*, 72*a* and 74*a* of switches 70, 72, 74 are preferably recessed below surface 32*c* to minimize accidental actuation thereof.

FIG. 2 also illustrates somewhat schematically opposed pairs of elongated slide contacts 84, 86 and 85, 87 suitably mounted on the action slide 48 and on the body 12, respectively, as shown, to provide an electrical signal to a suitable voltage intensifier, transformer or "coil" 89 associated with the aforementioned control circuit so that a firing signal may be delivered to the electric cartridge 30 by way of such coil and conductor 54.

Figure 3:
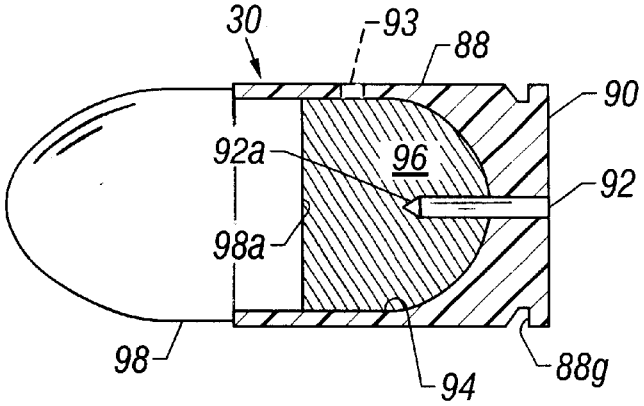
FIG. 3 is a central longitudinal section view of one embodiment of an electric cartridge in accordance with the invention.

Referring now to FIG. 3, there is illustrated in longitudinal central section an electric cartridge 30 in accordance with the present invention. The cartridge 30 includes a generally cylindrical cartridge casing 88 and a center electrode 92 projecting from the casing end face 90 into an internal cavity 94. The cavity 94 is preferably filled with a gas generating explosive charge material 96 which may be of a selected type, such as black powder. Moreover, the casing 88 may be made of nylon, polypropylene, an ABS polymer as described in my copending U.S. patent application Ser. No. 09/187,951 filed on Nov. 6, 1998 and entitled "Electric Impulse Cartridge", or a material as described in my application Ser. No. 08/688,085 filed Jul. 29, 1996 and entitled "Electrostatically Dischargeable Primer" now U.S. Pat. No. 5,996,500 issued Dec. 7, 1999. The electrode 92 may also be formed of a suitable material such as an ABS polymer composition doped with certain combinations of boron, magnesium, molybdenum trioxide, fluoroelastomers and barium chromate, for example, and also as described in the aforementioned patent applications.

The casing 88 supports a suitable metal or otherwise electrically conductive projectile or bullet 98 which may be fired through the barrel 22 upon ignition of the charge material 96. In the embodiment of the gun 10 illustrated herein the electrical circuit which ignites the charge 96 is completed through the conductor 54, the electrode 92, the gap between the tip 92*a* of the electrode, and the bullet end face 98*a*, the bullet 98 and the metal barrel 22. Alternatively, the conductive path operable to ignite the charge 96 may not require that the entire barrel 22 be of metal. An electrode 93 projecting through the sidewall of the casing 88 may, for example, be in contact with a suitable conductor ring 95 or the like in the breech 28, for example, and shown as an alternate conductive path in FIGS. 1 and 3.

Figure 4:
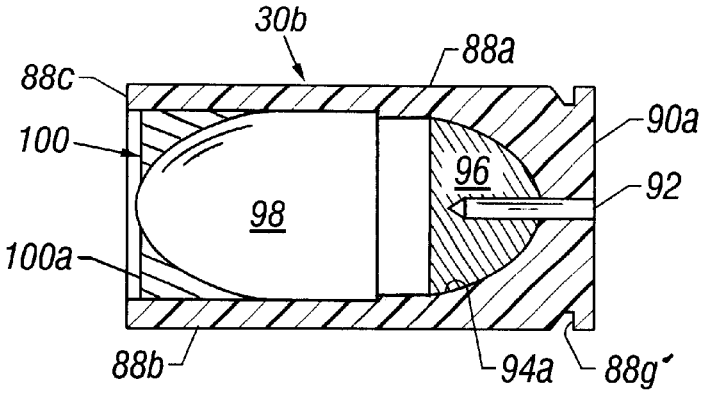
FIG. 4 is a longitudinal central section view of a second embodiment of an electric cartridge in accordance with the invention.

FIG. 4 illustrates a modified electric cartridge 30*b* having an elongated cylindrical non-conductive casing 88*a*, a transverse end face 90*a* and a center electrode 92 supported therein and opening into a charge cavity 94*a*. A suitable quantity of charge material 96 is disposed in cavity 94*a*. Unlike the cartridge 30, the casing 88*a* of cartridge 30*b* has a tubular portion 88*b* which is substantially coextensive with the bullet 98 and the bullet is engaged with a quantity of electrically conductive sealant 100 filling the casing cavity between the distal end 88*c* of the casing and the exterior surface of the bullet 98, as illustrated. The conductive sealant 100 is interposed in a conductive path which will be formed by barrel 22 and will include a relatively small gap between the barrel 22 and the face 100*a* of the sealant when the cartridge 30*b* is inserted in the breech 28, which path is completed through the bullet 98, material 96 and the electrode 92 to the center conductor 54, for example.

As shown in FIGS. 3 and 4, circumferential casing extractor grooves 88*g* and 88*g*' are provided on casings 88 and 88*a*, respectively, for engagement with suitable cartridge extractor means, not shown.

Figure 5:
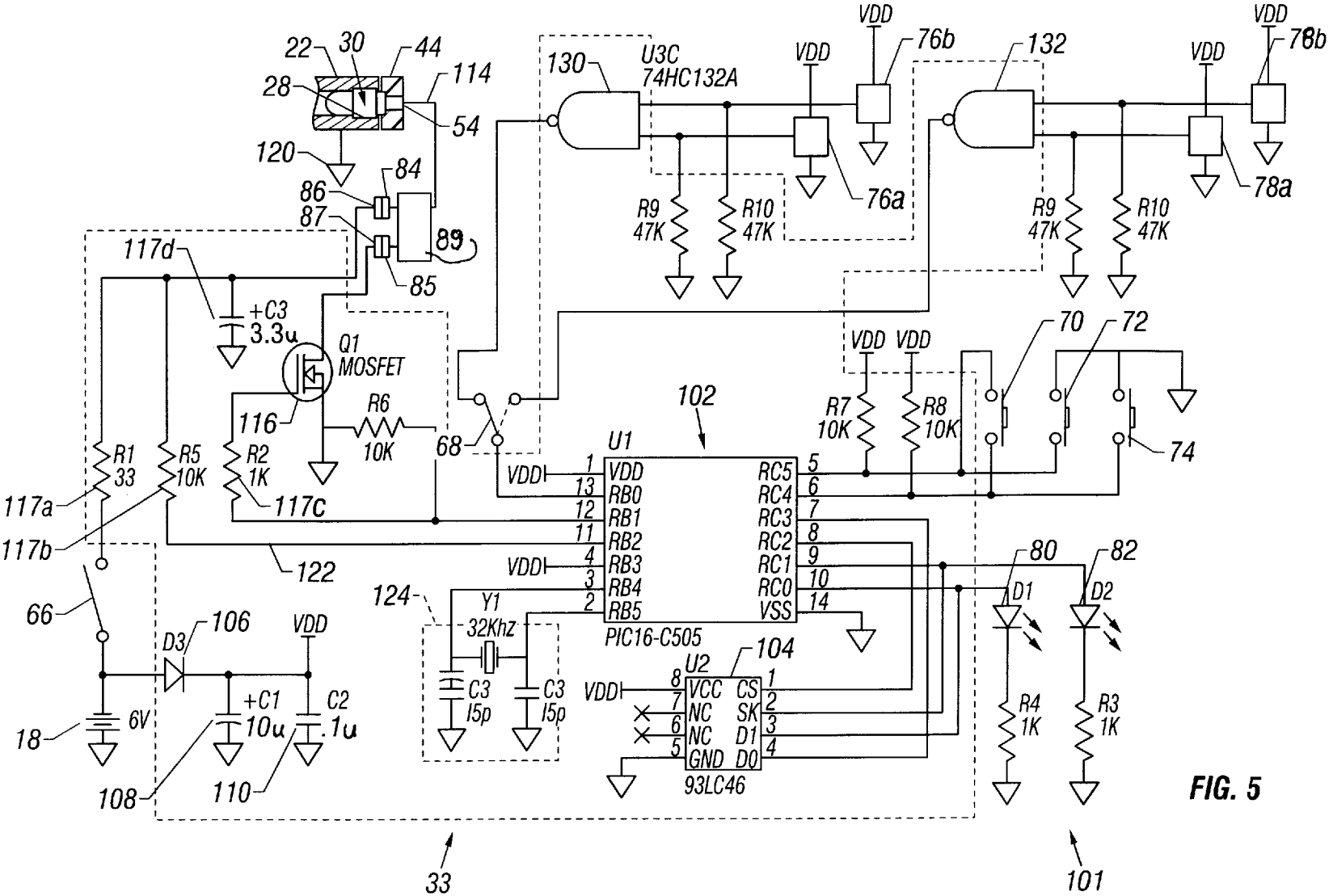
FIG. 5 is a schematic diagram of a circuit for the electric gun or firearm shown in FIGS. 1 and 2.

Referring now to FIG. 5, there is illustrated a schematic diagram of one preferred embodiment of a circuit 101 for effecting firing of the gun 10 and the electric bullet or cartridge 30. Certain ones of the circuit conductors illustrated in the schematic diagram of FIG. 5 are not shown in detail in the illustrations of FIGS. 1 and 2. However, those skilled in the art will appreciate that suitable conductors between the batteries 18, the switch 66, the switch 68, the barrel 22, the center conductor 54, the slide contacts 86 and 87 and the circuit of the enclosure 33 may be carried out by providing suitable conductors extending within the body 12 and a detailed description of such conductors, with respect to FIGS. 1 and 2, is not believed to be necessary for an understanding or practice of the present invention.

FIG. 5 illustrates those elements of a circuit 101 which are, for the most part, disposed within the enclosure 33 including a suitable central processing unit or microcontroller 102. The microcontroller 102 may be of a type commercially available, such as from Microchip Technology Corp. as their type PIC16-C505, for example. Microcontroller 102 is operably connected to an EEPROM memory circuit 104 providing for non-volatile storage of certain parameters required for firing a cartridge 30 or 30*b* by the gun 10, including acceptable identification codes input into the microcontroller by the switches 70, 72 and 74, as illustrated.

As shown in FIG. 5, batteries 18 are connected to trigger switch 66 and to a circuit including a diode 106 and bypass capacitors 108 and 110 providing suitable control voltage to the microcontroller 102 and certain other elements of the circuitry shown in FIG. 5. Switch 66 is also connected to voltage transformer or coil 89 operable to provide a suitable high voltage signal to the center conductor 54 from a secondary winding of the coil which is connected to suitable conductor means 114, as illustrated. Coil 89 is preferably mounted in slide 48 of action mechanism 42 and is operable to receive a signal via slide contact pairs 84, 86 and 85, 87 at its primary winding.

The circuit of FIG. 5 also includes a 1.0 to 2.0 kHz MOSFET 116 in circuit with the primary winding of the transformer or coil 89 and operable to provide a suitable on/off signal to the primary winding to effect inducing a high voltage signal in the secondary winding which is imposed on the cartridge 30 via the conductor 114 and through the cartridge, including the circuitry provided by the breech 28 of barrel 22 which is shown suitably connected to a ground conductor 120. Ground conductor 120 is shown by the symbol in FIG. 5 and is also indicated throughout the remainder of the schematic diagram of FIG. 5 by the same symbol in accordance with conventional practice.

Suitable current limiting resistors 117*a*, 117*b* and 117*c* and capacitor 117*d* are shown in circuit with the trigger switch 66, the coil 89, the MOSFET 116 and microcontroller 102, as indicated. On closing the switch 66 a suitable signal is sent to the microcontroller 102 by way of conductor 122 which will energize MOSFET 116 for a brief period of time causing MOSFET 116 to on/off cycle current through the primary winding of coil 89. An internal operating frequency or clock signal is provided to the microcontroller 102 by a circuit 124, as indicated in FIG. 5. As also shown in FIG. 5, the digital code input switches 70, 72 and 74 are connected to corresponding leads of the microcontroller 102, as indicated, and indicators 80 and 82, preferably comprising LEDs, are also operably connected to leads from the microcontroller.

Switch 68 is used to select the pair of sensors 76*a*, 76*b* or 78*a*, 78*b* which, are respectively, connected to suitable NAND gates 130 and 132, as indicated, to provide respective output signals to the microcontroller 102, depending on the position of the switch 68, to indicate when the gun 10 is being properly gripped. The detectors or sensors 76*a*, 76*b* and 78*a*, 78*b* may operate on an infra-red principle to detect a change in radiation sensed by the sensor pairs when a person's hand is disposed around the handgrip 32 of the gun or firearm 10. When both sensors of a pair detect a person properly gripping the gun 10 one or the other of gates 130 or 132 generates an output signal to microcontroller 102.

Accordingly, the circuit described above and shown in FIG. 5 may be provided with suitable identifying codes which are acceptable for allowing the MOSFET 116 to energize the coil 89 in a way which will provide a high voltage output signal to the cartridge 30 if all other operating parameters are satisfied. Once an accepted code has been entered in the microcontroller 102 and the microcontroller receives a suitable signal from a gate 130 or 132, MOSFET 116 will be operable, once the trigger switch 66 is closed, to provide a high voltage signal generated by the coil 89 to the cartridge 30 to effect firing thereof. The microcontroller 102 may be programmed for either semiautomatic or full automatic firing mode of operation of gun 10. In other words, as long as the switch 66 is closed, indicating that the trigger 60 has been pulled, the controller 102 will, with other input parameters being acceptable, allow the MOSFET 116 to provide the 1.0 to 2.0 kHz on/off signal to the coil primary winding to generate the high voltage signal in the secondary winding. When operating in the semi-automatic mode, the microcontroller 102 will not allow the MOSFET 116 to effect "firing" the coil 89 more than once or only for a sufficient length of time to allow one cartridge 30 or 30*b* to be fired, even though the switch 66 may remain closed. However, if programmed in the automatic mode the microcontroller 102 may allow the MOSFET 116 to continue "firing" as long as the switch 66 is closed. Accordingly, each time a cartridge 30 is fired and ejected and a new cartridge loaded in the breech 28, a firing signal will be imposed on the cartridge as soon as the action 42 including the breechblock 44 and bolt 46 reach the closed position shown in FIG. 1.

The operation of the electric gun 10 is believed to be understandable to those of ordinary skill in the art based on the foregoing description. Moreover, the construction of the gun 10 is believed to be within the purview of one of ordinary skill in the art of semi-automatic and automatic firearms, as well as so called single shot firearms, based on the drawings and the description hereinabove. Although a preferred embodiment of the invention has been described in certain detail herein those of ordinary skill in the art will also recognize that various substitutions and modifications may be made to the invention without departing from the scope and spirit of the appended claims.

What is claimed is:

1. An electric gun for firing a cartridge including a casing, a charge of electrically ignited gas generating material in said casing and a projectile mounted at said casing and operable to be propelled by said charge upon ignition thereof, said gun comprising:

a barrel including a breech for receiving said cartridge therein;

a movable action for engaging and holding said cartridge in said breech, said action including a conductor engageable with an electrode on said cartridge;

a trigger adapted to be actuated to effect firing of said cartridge;

a control circuit including a switch and a source of electric energy operably connectable to said conductor and responsive to actuation of said trigger to effect firing said cartridge;

a handgrip portion of said gun; and a first pair of spaced apart sensors mounted on said handgrip portion in positions, respectively, such that one hand of a person holding said gun in a conventional firing position with said one hand will be detected by said first pair of sensors.

2. The electric gun set forth in claim 1 wherein:

said control circuit is operable to prevent generation of a firing signal except when said first pair of sensors detects a person holding said gun in said conventional firing position with said one hand.

3. The electric gun set forth in claim 1 including:

a second pair of spaced apart sensors mounted on said handgrip portion in positions, respectively, such that the other hand of a person holding said gun in a conventional firing position with said other hand will be detected by said second pair of sensors.

4. The electric gun set forth in claim 3 wherein:

said control circuit is operable to prevent generation of a firing signal except when said second pair of sensors detects a person holding said gun in said conventional firing position with said other hand.

5. The electric gun set forth in claim 3 wherein:

said sensors comprising infrared radiation detectors, respectively.

6. The electric gun set forth in claim 1 wherein:

said control circuit includes a voltage intensifier mounted on said movable action for increasing the voltage from said source of electric energy to produce a high voltage firing signal to effect firing said cartridge.

7. An electric gun for firing a cartridge including a casing, a charge of electrically ignited gas generating material in said casing and a projectile mounted at said casing and operable to be propelled by said charge upon ignition thereof, said gun comprising:

a barrel including a breech for receiving said cartridge therein;

a movable action for engaging and holding said cartridge in said breech, said action including a conductor engageable with an electrode on said cartridge;

a trigger adapted to be actuated to effect firing of said cartridge;

a control circuit including a switch and a source of electric energy operably connectable to said conductor and responsive to actuation of said trigger to effect firing said cartridge;

a handgrip portion of said gun; and a voltage transformer mounted on said movable action and operably connected to said control circuit for increasing the voltage from said source of electric energy to produce a high voltage firing signal at said conductor to effect firing said cartridge.

8. The electric gun set forth in claim 7 wherein:

said control circuit includes slide contactors mounted on a frame of said gun and on said movable action, respectively, and engageable to communicate electrical signals between said control circuit and said transformer.

9. An electric gun for firing a cartridge including a casing, a charge of electrically ignited gas generating material in said casing and a projectile mounted at said casing and operable to be propelled by said charge upon ignition thereof, said gun comprising:

a barrel including a breech for receiving said cartridge therein;

a movable action for engaging and holding said cartridge in said breech, said action including a conductor engageable with an electrode on said cartridge;

a trigger adapted to be actuated to effect firing of said cartridge;

a control circuit including a trigger switch and a source of electric energy operably connectable to said conductor and responsive to actuation of said trigger to effect firing said cartridge;

a handgrip portion of said gun; and plural digitally actuatable switches mounted on said handgrip portion of said gun and operably connected to said control circuit for inputting a multi-digit authorization code to said control circuit to allow said control circuit to effect generation of a firing signal upon actuation of said trigger, each of said digitally actuatable switches being mounted in a recess of said handgrip portion, respectively, to minimize accidental actuation of respective ones of said digitally actuatable switches when said handgrip portion is grasped by a person handling said gun.

10. The electric gun set forth in claim 9 including:

a first pair of spaced apart sensors mounted on said handgrip portion in positions, respectively, such that a person holding said gun in a conventional firing position with one hand will be detected by said first pair of sensors.

11. The electric gun set forth in claim 10 including:

a second pair of sensors mounted on said handgrip portion in positions, respectively, such that a person holding said gun in a conventional firing position with the other hand will be detected by said second pair of sensors; and said control circuit is operable to prevent generation of said firing signal except when one of said first pair of sensors and said second pair of sensors detects a person holding said gun in said conventional firing position with one of said hands.

12. The electric gun set forth in claim 11 wherein:

said sensors comprise infrared radiation detectors, respectively.

13. The electric gun set forth in claim 9 wherein:

said control circuit includes a transformer coil mounted on said movable action for increasing the voltage from said source of electric energy to produce a high voltage for said firing signal to effect firing said cartridge.

14. The electric gun set forth in claim 9 wherein:

said recesses for said digitally actuatable switches are disposed spaced apart along a rearward facing surface of said handgrip portion.

15. An electric handgun for firing a cartridge including a casing, a charge of electrically ignited gas generating material in said casing and a projectile mounted at said casing and operable to be propelled by said charge upon ignition thereof, said handgun comprising:

a barrel including a breech for receiving said cartridge therein;

a movable action for engaging and holding said cartridge in said breech, said action including a conductor engageable with an electrode on said cartridge;

a trigger adapted to be actuated to effect firing of said cartridge;

a control circuit including a trigger switch and a source of electric energy operably connectable to said conductor and responsive to actuation of said trigger to effect firing said cartridge;

a handgrip part of said handgun;

plural digitally actuatable switches mounted on said handgrip part of said gun and operably connected to said control circuit for inputting a multi-digit authorization code to said control circuit to allow said control circuit to effect generation of a firing signal upon actuation of said trigger, each of said digitally actuatable switches being mounted in a recess of said handgrip part, respectively, to minimize accidental actuation of said digitally actuatable switches when said handgrip part is grasped by a person handling said handgun;

a first pair of sensors mounted spaced apart on said handgrip part and disposed to detect a person holding said handgun by said handgrip part in a conventional firing position with one hand; and a second pair of sensors mounted spaced apart on said handgrip part and disposed to detect a person holding said handgun by said handgrip part in a conventional firing position with the other hand.

* * * * *